United States Patent [19]

Cameron, Jr. et al.

[11] 4,427,484

[45] Jan. 24, 1984

[54] AUTOMATIC LABELING SYSTEM

[75] Inventors: Allan M. Cameron, Jr., LaGrange; Charles G. Middleton, Burbank, both of Ill.

[73] Assignee: Camtron Systems, Inc., Addison, Ill.

[21] Appl. No.: 402,992

[22] Filed: Jul. 29, 1982

[51] Int. Cl.[3] ..... B44C 1/00

[52] U.S. Cl. ..... 156/361; 156/363; 156/391; 156/542

[58] Field of Search ..... 156/540–542, 156/584, 361–363, 391

[56] References Cited

U.S. PATENT DOCUMENTS

| | | | |
|---|---|---|---|
| 3,238,080 | 3/1966 | Schluter | 156/542 X |
| 3,944,455 | 3/1976 | French | 156/361 |
| 3,992,244 | 11/1976 | Craig et al. | 156/584 X |
| 4,019,945 | 4/1977 | Look et al. | 156/584 X |
| 4,270,968 | 6/1981 | Dudyik et al. | 156/542 X |

OTHER PUBLICATIONS

Camtron Brochure No. 5120, dated 1979, Camtron Systesm, Inc. 444 Interstate Road, Addison, Illinois 60101.

*Primary Examiner*—David A. Simmons

*Attorney, Agent, or Firm*—Trexler, Bushnell & Wolters, Ltd.

[57] ABSTRACT

An automatic labeling system is provided for applying an elongate label to a preselected curved surface of each of a plurality of objects which move in succession along a given path of travel past a stationary work station. This system comprises an applying assembly at the work station for applying a label to each of the curved surfaces, a supply and transport assembly for feeding elongate labels to the applying assembly at a controllable speed, a guide roller for positioning the applying assembly relative to each curved surface and a control apparatus for controlling the operation and speed of the transport in a predetermined fashion.

27 Claims, 11 Drawing Figures

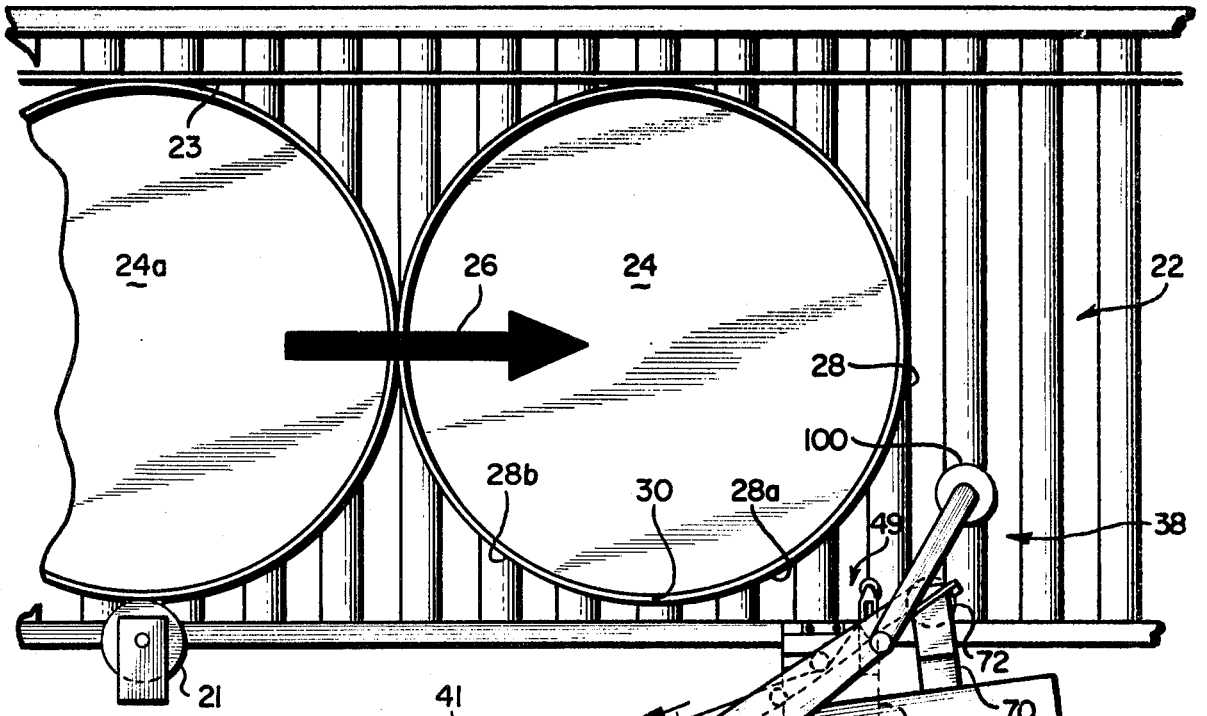
FIG. 2
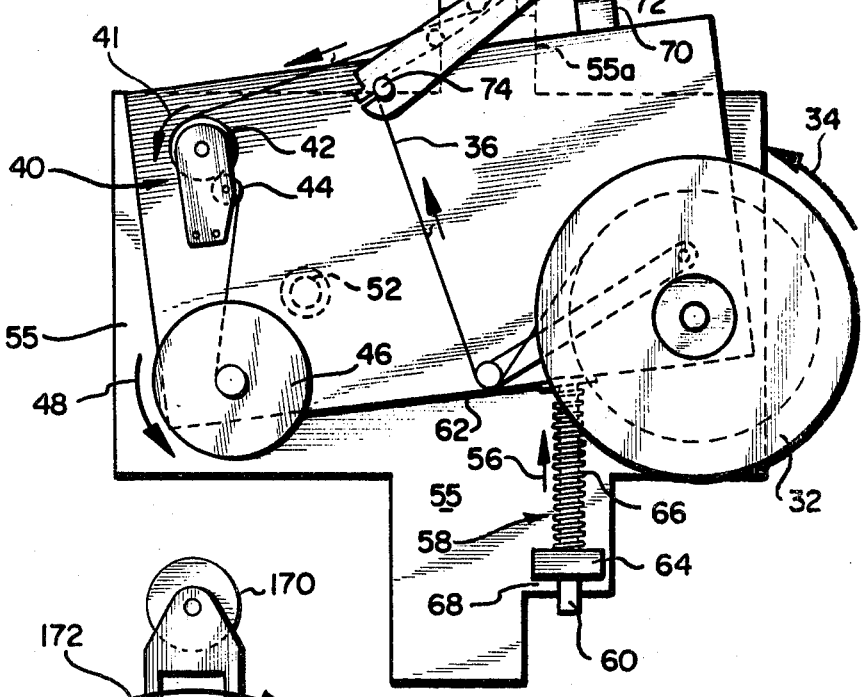
FIG. 7
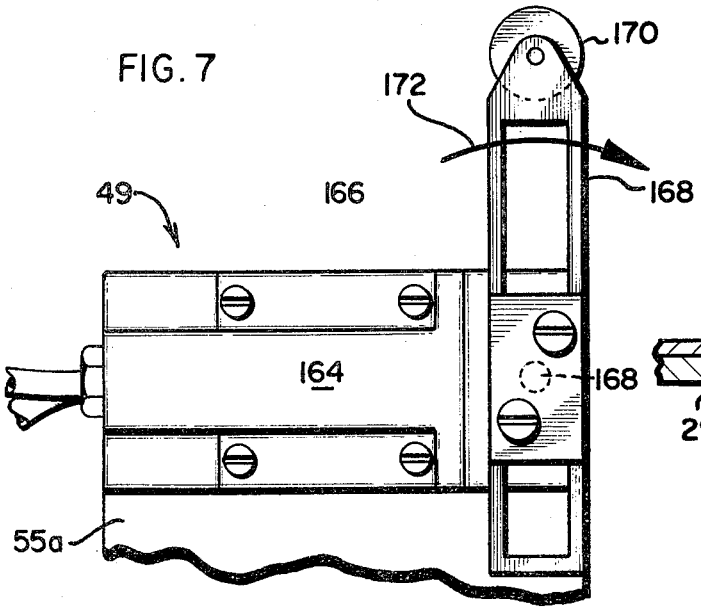
FIG. 6
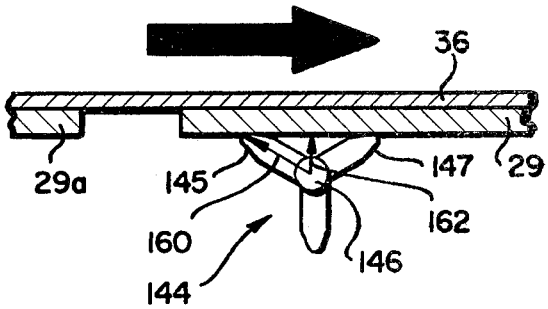

AUTOMATIC LABELING SYSTEM

BACKGROUND OF THE INVENTION

The present invention is directed generally to the label applying arts and more particularly to a novel and improved automatic labeling system for applying an elongate label to each of a plurality of relatively large objects moving substantially in a straight line past a fixed labeling station.

Labeling machines for automatically applying gummed or adhesive-backed labels to relatively small containers or the like on an assembly line or conveyor are well known. Generally speaking, such apparatus comprises a supply of adhesive-backed labels carried upon a carrier strip comprising an elongate web of release liner material which is fed from a supply reel to a takeup reel, with a suitable label applying device intermediate the two reels. Generally speaking, such a label applying device may include a peeler plate which comprises a plate having a relatively sharply angled edge. The adhesive-backed labels peel or "flag" from the carrier strip as this strip is fed around the sharp edge of the peeler plate. A suitable carrier strip transport device including suitable idler wheels and drive wheels is generally provided for this purpose intermediate the supply reel and takeup reel.

When relatively small objects such as cans, bottles or the like are being labeled this system works quite well. Such relatively small objects may also be readily rotated or otherwise manipulated to aid in receiving labels. Since the relative surface velocity of such small objects does not vary greatly as they rotate and pass by the label applying device, such systems generally work satisfactorily at some a predetermined, constant speed of the web or release liner transport drive. Moreover, suitable mechanical positioning means may be used in conjunction with the conveyor for assuring proper positioning and rotation, if desired, of the relatively small containers to receive the labels from the peeler plate or applying device.

However, a number of problems arise when an analogous labeling system is to be utilized for applying labels to relatively large, heavy objects moving down a conveyor line. For example, relatively large and heavy chemical-containing drums are difficult and sometimes even dangerous to rotate or otherwise manipulate by mechanical means while being carried on a conveyor belt or line. Accordingly, a labeling apparatus at a work station adjacent the conveyor must perform the necessary movements to completely apply labels to the generally cylindrical side surfaces of such drums.

In applying elongate labels to such a moving, curved surface, a number of problems arise. For example, the speed or velocity of the curved surface relative to the label applying device or peeler plate varies considerably as the drum moves by in a generally straight line. More specifically, the required speed of the label to follow this curved surface generally decreases as the drum and curvature of the surface both approach the labeling station and up to the midpoint of the drum. However, this required speed increases past the drum midpoint as both the curved surface and the drum recede from the label applying station. These variations in speed and in particular the increasing speed as the drum recedes causing jamming and tearing of the labels and backing release liner or web, rendering the automatic labeling system inoperative after as few as two or three drums have passed by. Needless to say, stopping the system for rethreading of the label-bearing web or release liner after every second or third item is unacceptable.

Advantageously, we have found that the foregoing problem may be overcome by transporting the label-bearing web at one speed while the curvature of the drum is approaching the applying device and at a second, higher speed as this curvature is receding. Additionally, the drive or feed to the applying device or peeler plate may be halted between drums on the assembly line. Advantageously, we have discovered means for halting the drive while still leaving a portion of the next label flagged out to achieve initial contact with the next drum surface when the next drum reaches the label applying station.

The foregoing requires the addition of a suitable control system for the drive and feeding of the label-bearing web to and through the applying device or peeler plate. However, since such an applying system must also be safe for use in hazardous environments, the control system should preferably be other than electrical. For example, many uses may involve application of labels to drums containing volatile or potentially volatile chemicals. Hence, we have also developed a novel non-electrical, fluidic-mechanical control system.

OBJECTS AND SUMMARY OF THE INVENTION

Accordingly, it is a general object of the invention to provide an automatic label applying system for applying elongate labels to curved surfaces of relatively large objects which substantially avoids the foregoing problems.

A more specific object is to provide a labeling system in accordance with the foregoing object which is adapted to sense the presence and relative velocity of a curved surface and control the feeding and application of a label to said surface in accordance with this determination.

A related object is to provide a system in accordance with the foregoing objects which achieves sensing and control without the use of electrical components, so as to be suitable for use in volatile or potentially volatile environments.

A further object is to provide a system in accordance with the foregoing objects which is relatively simple and inexpensive in its manufacture and design and yet highly reliable in operation.

Briefly, and in accordance with the foregoing objects, an automatic labeling system is provided for applying an elongate label to a preselected curved surface of each of a plurality of objects which move in succession along a given path of travel past a stationary work station. In accordance with the invention, this system comprises applying means at said work station for applying said label to each said curved surface, controllable feed means for feeding said elongate labels to said applying means at a controllable speed, guide means for positioning said applying means relative to each said curved surface and control means for controlling the operation and speed of said feed means in a predetermined fashion.

BRIEF DESCRIPTION OF THE DRAWINGS

The foregoing, as well as other objects, features and advantages of the invention will become more readily apparent upon reading the following detailed description of the illustrated embodiment, together with reference to the drawings wherein:

FIG. 2 is a top plan view of the apparatus, drum and conveyor of FIG. 1;

FIG. 6 is a simplified showing of a portion of the sensing component of FIG. 5, further illustrating the operation thereof;

FIG. 7 is an enlarged top plan view of a portion of the apparatus of FIG. 1 illustrating a drum sensing portion thereof;

DETAILED DESCRIPTION OF THE ILLUSTRATED EMBODIMENT

Figure 1:
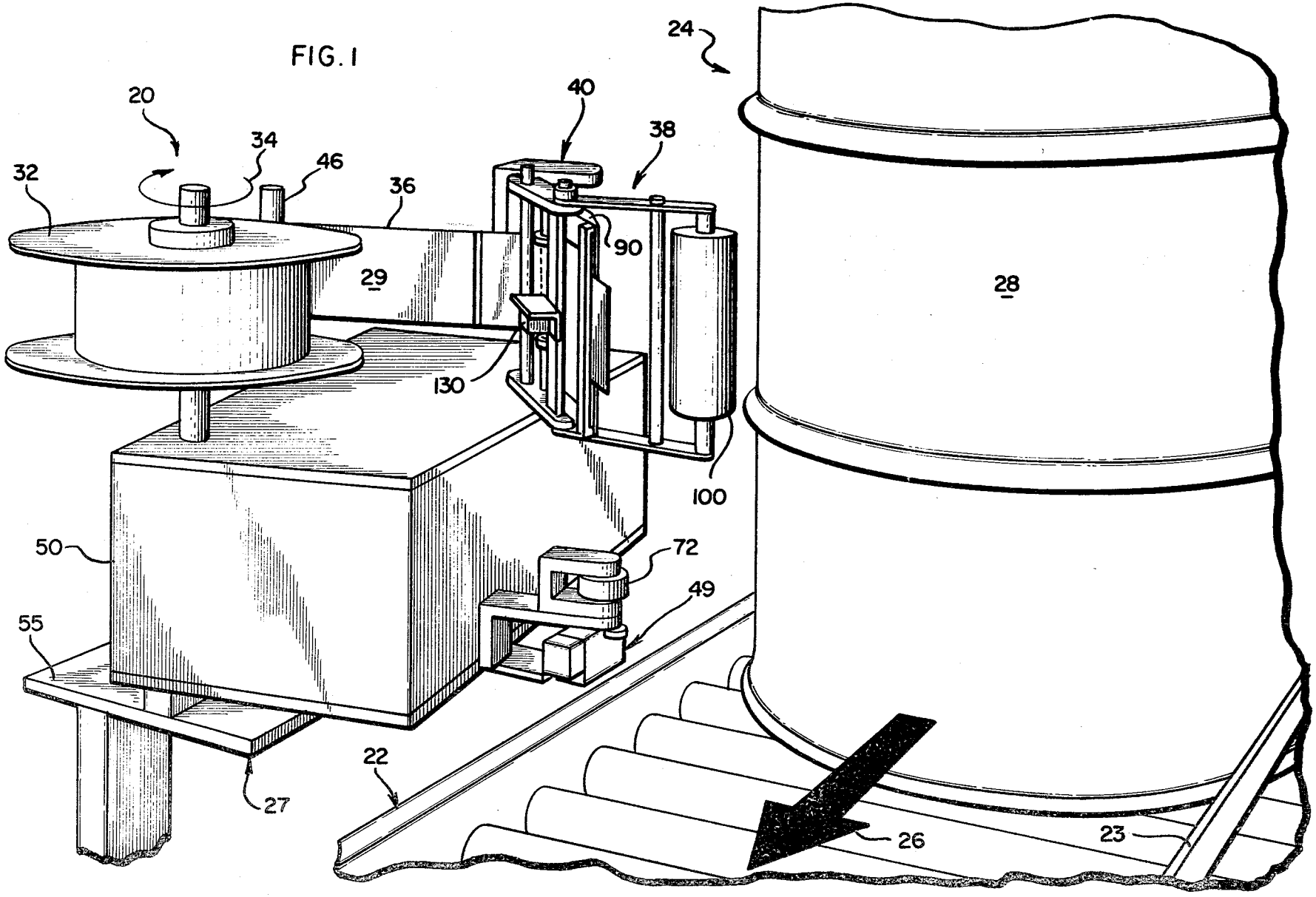
FIG. 1 is a perspective view of an automatic labeling apparatus in accordance with the invention together with a conveyor carrying a drum to which a label is to be applied.

Referring to the drawings, and initially to FIGS. 1 and 2, an automatic label applying system or apparatus in accordance with the invention is designated generally by the reference numeral 20. To facilitate description of the invention, the apparatus 20 is illustrated in conjunction with a conveyor line 22 which carries a plurality of large objects such as generally cylindrical drums 24. In the illustrated embodiment, this conveyor line 22 carries the drums 24 in a generally linear path of travel as indicated by the arrow 26. In this regard, suitable means such as a bumper or roller 21 and a guide rail 23 may be utilized to assure that each drum 24 moves along substantially the same path or line 26. Hence, the drums 24 moving on the conveyor 22 along path of travel 26 individually and sequentially pass by a fixed work station or platform 27 upon which the apparatus 20 of the invention is mounted.

It will be appreciated that the system 20 of the invention may also be utilized for applying labels to other objects moving down the conveyor line 22, and hence the invention is not limited to the specific embodiment illustrated and described herein.

Generally speaking, the labeling system 20 of the invention applies an elongate label 29 from a strip 36 to the curved side surface 28 of each drum 24. As these drums 24 are generally cylindrical in the illustrated embodiment, the surfaces 28 are generally circular in curvature. Accordingly, a leading portion 28*a* of the surface 28 up to and including a center line or midpoint 30 thereof generally approaches or moves toward the labeling system 20 as the drum 24 moves in the direction of arrow 26. Conversely, to the other side of the center line or midpoint 30 the curvature 28*b* of the drum generally recedes or moves away from the labeling system 20.

From the foregoing description of movement of the drum 24 and in particular of the curved surface 28 thereof relative to the fixed work station 27 and label applying system 20, many of the features and advantages of the invention o be hereinafter described will be more readily appreciated.

Referring now to the label applying system 20, it will be seen that a strip 36 which carries a supply of labels 29 is carried on a supply reel 32. This supply reel 32 is preferably free to rotate in the direction indicated generally by the arrow 34 to supply a strip 36 of labels to a label applying apparatus designated generally by the reference numeral 38 which will be described in detail later.

Figure 5:
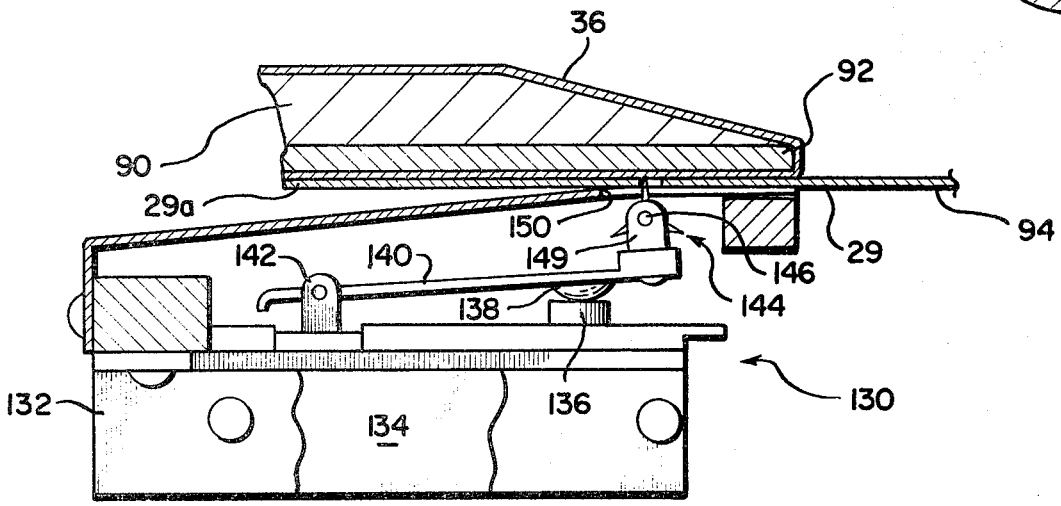
FIG. 5 is an enlarged developmental view taken generally along the line 5—5 of FIG. 3 illustrating a label sensing component.

In accordance with a preferred form of the invention, and as best viewed in FIG. 5, the strip 36 preferably comprises a flexible web or release liner which carries a supply of adhesive-backed labels 29. The path of the strip 36 through the label applying apparatus 38 will be described later. After traversing the applying apparatus 38 the strip 36, now devoid of labels, traverses a drive mechanism 40 which comprises a drive wheel 42 which rotates in a direction 41 and a suitable spring biased pinch wheel 44 that holds strip 36 in contact with drive wheel 42. From this drive mechanism 40, the strip 36 is fed onto a takeup reel 46 which is driven to rotate in the direction generally indicated by the arrow 48. This latter takeup wheel is preferably driven at a speed commensurate with the speed of the drive or transport mechanism 40, to take up the remaining web or release liner material of the strip 36 following application of the labels 29 therefrom to the drums 24.

In accordance with a feature of the invention, all of the foregoing structures are carried upon a housing 50 which is pivotally mounted at a pivot or other suitable structure 52 to a surface 55 of stationary platform 27 Moreover, the platform 27 mounts a drum sensing structure designated generally by the reference numeral 49 which senses the presence and relative position of curved surface 28. This assembly 49 will be described in detail later herein. Housing 50 is urged generally in the direction of the conveyor as indicated by arrow 56 about the pivot point 52 by a resilient spring biasing structure designated generally by the reference numeral 58.

In the illustrated embodiment, this resilient biasing structure 58 comprises a rod 60 which bears against a rear side wall 62 of the housing 50 at a point remote from the pivot 52. The opposite end of this rod 60 is journaled through a suitable bushing block 64 spaced apart from the rear walls 60 of the housing 50. Intermediate the wall 62 and block 64, a suitable coil compression spring 66 is provided around the rod 60 for urging the housing 50 generally in the direction 56, pivoting about the pivot point or pin 52. The extent of this movement may be limited by a suitable stop such as a pin 68 at the free end of the rod 60.

Positioning of the housing 50 with respect to the drum 24 is achieved by a guide mechanism or roller comprising an outwardly extending arm 70 which extends generally in the direction 56 into the conveyor 22 and a roller 72 carried at the remote or outer end of this arm 70. This arm 70 is rigidly mounted to the housing 50 and accordingly is urged by the spring biasing structure 58 into contact with the surface 28 of the drum 24. As will be seen presently, the label applying structure or assembly 38 is positioned on the housing in a fixed relationship to this arm 70 and guide roller 72, so as to be spaced apart a sufficient distance from the surface 28 to reliably apply a label thereto from the strip 36.

Figure 3:
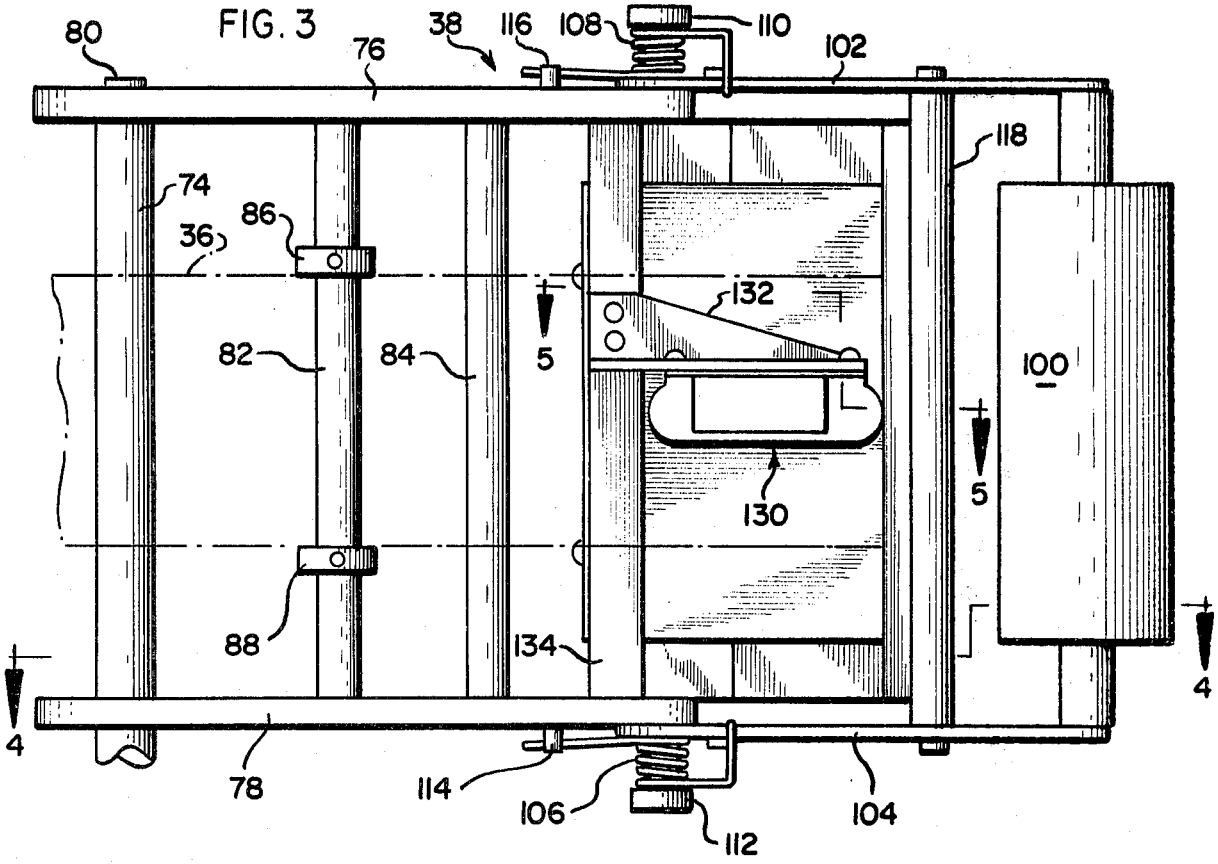
FIG. 3 is an enlarged elevation of a label applying portion of the apparatus of FIGS. 1 and 2.
Figure 4:
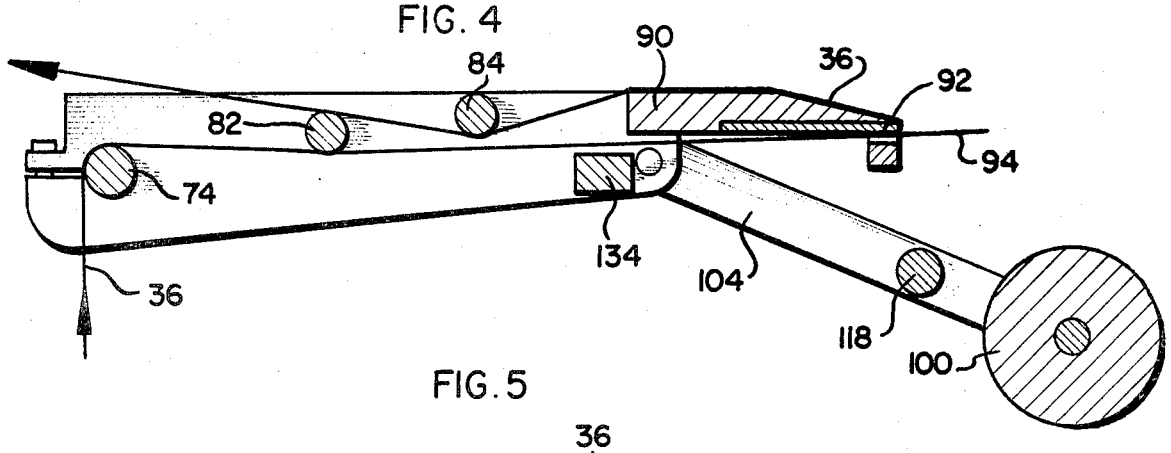
FIG. 4 is an enlarged developmental view taken generally along the line 4—4 of FIG. 3.

Reference is next invited to FIG. 3 and FIG. 4 wherein further details of the label applying assembly 38 are illustrated. Initially, it will be noted that the assembly 38 is held at a fixed, predetermined angle with respect to the housing 50 by suitable means such as a mounting bar 74 and mounting brackets 76, 78, affixed to the bar 74 by suitable means such as a bolt or fastener 80. The mounting bar 74 also serves as a guide for the strip 36, as viewed in FIG. 4, the strip 36 proceeds from the supply reel 34 of FIG. 2.

Additional guides for the web or strip 36 are provided in the form of additional transverse cylindrical bars or guides 82 and 84 which also traverse the mounting brackets 76, 78. Preferably the latter guide bar 84 is also provided with a pair of guide hubs 86, 88 which serve to substantially center the strip 36 thereupon. At the outer end of the applying apparatus 38 is mounted a peeler plate 90 which in accordance with conventional practice generally comprises a thin, substantially flat plate which converges to a somewhat blunted leading edge or nose 92.

In the illustrated embodiment, the web or strip 36 is fed around the first guide bar 74 and under the second guide bar 82 and around this peeler plate edge 92. As is known in the art, feeding of the adhesive label-bearing web or release liner 36 about this edge 92 causes "flagging" of the label 29. That is, a leading edge 94 of a label 29 separates from the release liner strip 36 as it is fed around this edge 72.

Thereafter, the web or release liner strip 36 with the labels 29 removed therefrom continues around the opposite side of the peeler plate 90 and to the underside of the guide bar 84 as viewed in FIG. 4, and to the top side of the guide bar 82 also is viewed in FIG. 3 to the transport or drive mechanism 40 as described above with reference to FIG. 2.

The applying assembly further includes a following press roller 100, preferably of a relatively soft, resilient rubber-like material, which is mounted at the outer end of a pair of outwardly extending arms 102, 104. Arms 102, 104 are preferably spring-biased by suitable means including a springs 106, 108 to bear against the surface 28 of the drum 24 following application of the label 29 thereto. Hence the roller 100 serves to press the adhesive-backed label 29 firmly into adhesive engagement with the surface 28 of the drum 24.

In this regard, it will be seen that the springs 106, 108 are coiled about suitable bolts or fasteners 110, 112 which also pivotally mount the arms 102, 104 with respect to the mounting plates or arms 76, 78. Respective free ends of the springs 106, 108 bear against bosses or projections 114, 116 on the respective mounting plates 62 and 64, and against the respective arms 102, 104. In FIG. 4, the roller 100 and arms 102,104 have been illustrated in a pulled back (with respect to the normal direction of urging by springs 106, 108) position to facilitate the description. An additional support bar 118 may also be provided transversely joining the respective arms 102 and 104.

Reference is now also invited to FIGS. 5 and 6 wherein details of a label position sensor assembly designated generally by the reference numeral 130 are illustrated. As will be seen with reference to FIG. 3, this assembly 130 is carried on a bracket 132 mounted to a transverse bar 134 generally behind the peeler plate 90. The sensor assembly 130 is thus positioned to sense or detect the label-bearing web or release liner strip 36 immediately before it reaches the edge 92 of the peeler plate 90.

In FIG. 5, a portion of the peeler plate 90 including the outer edge or nose 92 thereof is again illustrated. It will be seen that the release liner strip 36 flags out a leading portion 94 of each label 29 as the release liner strip 36 passes around this leading edge or nose 92. Additionally, it will be seen that the label sensor assembly 130 is mounted by means of the bracket 132 closely adjacent the peeler plate 90. The sensor assembly 130 generally comprises an air switch component schematically illustrated at 134 which is actuated by an outwardly extending plunger member 136. This plunger 136 is in turn selectively actuated by a protrusion or boss 138 carried on a pivotally mounted arm 140. The pivot structure 142 for the arm 140 is laterally spaced from the plunger 136. The outer or free end of this arm 140 carries a sensing component comprising a three-arm star wheel 144 which is rotatably mounted at 146 to a suitable bracket 149.

Referring briefly to FIG. 6, it will be seen that two adjacent ones 145, 147 of the arms of this star wheel 144 normally slidably engage or ride upon the surface of a label 29 as it is carried thereby on the strip 36. However, upon encountering a gap 140, preferably of on the order of $\frac{1}{8}$ inch wide which is provided between adjacent labels 29 on the strip 36, the star wheel 144 is caused to rotate. In this regard, it will be recognized that the trailing one 145 of the arms slidably engaging the label 29 will be urged into this gap 140 thereby causing an initial amount of rotation of the wheel 144. Moreover, the pivotally mounted arm 140 is preferably spring-biased to urge the star wheel 144 into engagement with the strip 36 and labels 29 carried thereupon. Hence upon the approach of the leading edge of the next succeeding label **29*a*, this arm 145 of the star wheel 144 will be further rotated about its axis 146**.

It will be recognized that the distance 160 from the axis or hub 146 of the star wheel 144 to the outer periphery of one of its arms (e.g. 145) is greater than the distance 162 from this axis or hub 146 to a line joining the outer points of two arms (e.g. 145 and 147). Hence, when the wheel is in the position illustrated in FIG. 5, the arm 140 will be pushed downwardly a sufficient distance so that the protrusion or boss 138 engages and actuates the plunger 136, thereby actuating the air switch 134. In the illustrated embodiment, a suitable apertured cover plate 148 is also provided having a small through aperture or window 150 through which the star wheel 144 engages the strip 36, so as to minimize the affect of dirt, dust or the like upon the operation of the sensor structure 130 of FIG. 5.

Referring to FIG. 7, the drum sensor 49 will be seen to include an air switch 164 similar to the air switch 134 of FIG. 5. This second air switch 164 is mounted on an extension **55*a* of the table or surface 55 to be actuated by an actuator 166 which is pivotally mounted thereto at 168. Briefly, the actuator 166 comprises an elongate arm 167 which extends into the path of travel 26 of the drums 24 and includes a rotatable wheel or roller 170 at the free end thereof for rotatably engaging the surface 28 of the drum 24. Accordingly as the leading portion 28*a* of the drum 24 engages the roller or wheel 170, the pivotally mounted arm 166 is urged generally in the direction indicated by the arrow 172, thereby actuating the air switch 164. It will be appreciated that at some point on the surface portion 28*b* following the midpoint 30 of the drum 24, the pivotally mounted arm 166, which is suitably spring loaded, will resiliently return to substantially the position shown in FIG. 7, thereby de-activating the air switch 164**.

The label sensor 130 of FIGS. 5 and 6 and the drum sensor 49 of FIG. 7 form part of a novel pneumatic control system for controlling the speed of the web 36 through the label-applying assembly 38. In particular, this control system, to be described later with reference to FIG. 11, controls the rotational speed of the drive roller 42 of the drive mechanism 40 and of the takeup reel 46 described above with reference to FIG. 2. Preferably, this speed is controlled such that the label 29 is supplied at a first predetermined speed or velocity to the surface portion 28*a* and to a predetermined part of the surface portion 28*b* and thereafter, the speed or velocity is increased for applying the label to the remaining receding part of the drum surface portion 28*b*. In this regard, It will be remembered that the relative velocity of this latter surface 28*b* relative to the fixed work station 27 generally increases as the drum 24 moves along the path of travel 26.

Figure 8:
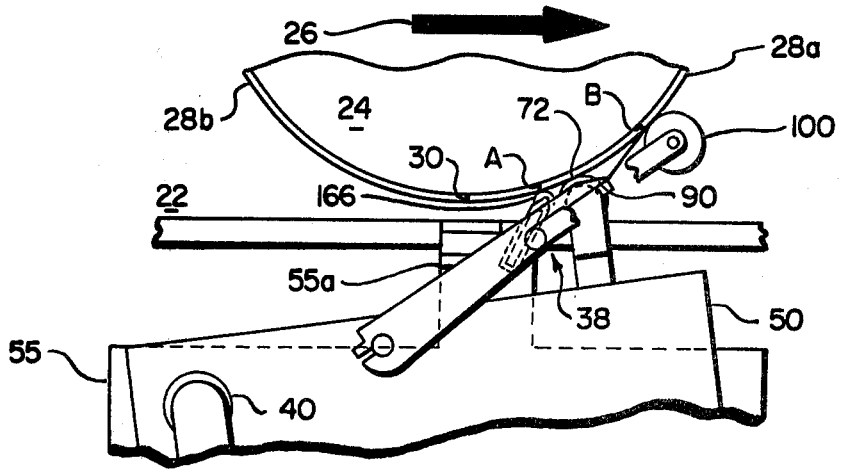
FIGS. 8 through 10 are simplified top plan views of the system of FIG. 1, together with a portion of the conveyor and drums, illustrating the sequence of operation of the apparatus of the invention for applying a label to a drum.
Figure 9:
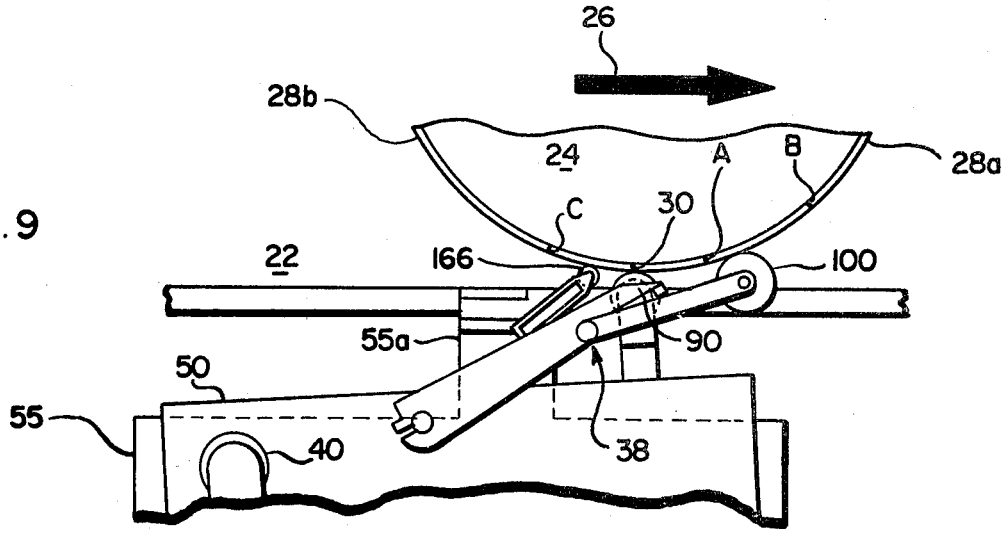
Figure 10:
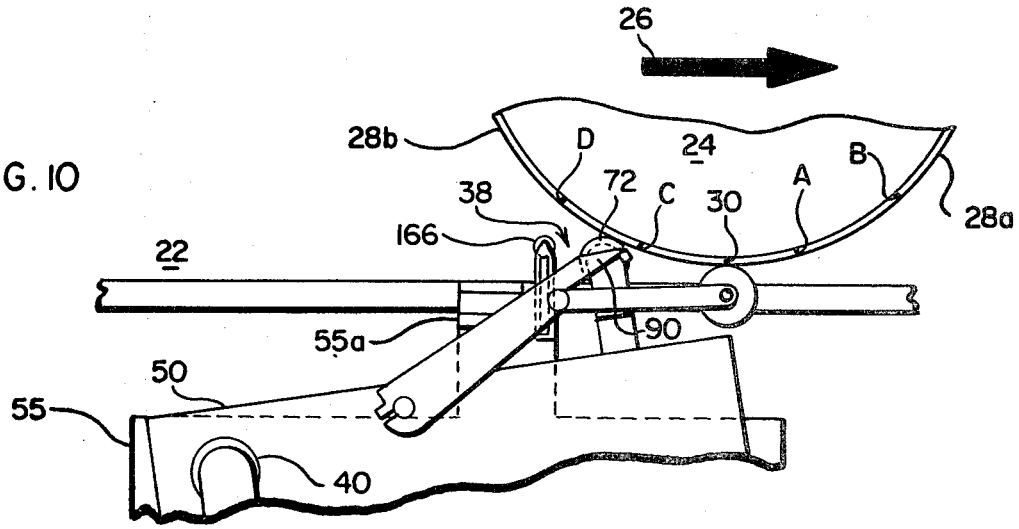

The operation of the foregoing structure for applying a label 29 to the curved surface 28 of an object such as a drum 24 will now best be appreciated with reference to FIG. 2 and to FIGS. 8 through 10. As already described, the housing 50 is pivotally mounted at a pivot point 52 with respect to the fixed surface 55. Additionally, spring biasing structure 58 urges the housing 50 and hence guide roller 66 and label applying structure 38 toward the surface 28 of the drum 24 as it moves along the line of travel 26 upon the conveyor 22. The pivotally mounted actuator 166 of the drum sensor assembly 49 yieldably extends into the path of travel 26 of the drum 24. In FIG. 2, the foregoing components are shown as positioned prior to the arrival of an approaching drum 24.

In FIG. 8, the foregoing components are shown as positioned substantially upon initial contact of the actuator 166 with a point A on the surface portion 28*a* of the drum 24. Here, it will be seen that the guide roller 66 is also in rolling contact with the leading peripheral surface portion 28*a* of the drum 24 and consequently, the edge 92 of the peeler plate 90 is held spaced substantially $\frac{1}{8}$- to $\frac{1}{4}$-inch from the surface 28 of the drum 24. The flagging of the label described above causes a leading edge 94 of the label to initially contact and adhesively engage a point B on the curved surface 28, and shortly thereafter the press roller 100 further enhances this adhesive engagement.

As also viewed in FIG. 8, the actuator 166 of the drum position sensor 49 (see FIG. 7) is pivotally moved to the right as viewed in FIG. 8, actuating the associated air switch 164. This indicates to the control unit that the portion 28*a* of the surface 28 is now in contact with the label applying apparatus 38. As mentioned above, this first half 28*a* of the surface generally approached closer to the applying mechanism 38 as the drum 28 moves in the direction or path of travel 26 along the conveyor 22. Hence, the velocity of the label 74 required to follow this curved surface 28*a* generally decreases as the drum 24 moves in the direction 26.

Referring now to FIG. 9, it will be seen that the label applying mechanism 38 and in particular the edge 92 of the peeler plate 90 is approximately aligned with the midpoint 30 of the surface 28 of the drum 24. The actuator 166 of the drum position sensor 49 remains in its outwardly pivoted position actuating the air switch 164 as described above with reference to FIG. 7. The actuator 166 will return to its original position when a point C of the surface 28*b*, substantially equidistant with the point A from midpoint 30 reaches the actuator 166. This in turn signals the control structure of FIG. 11 that the remaining portion of the trailing surface 28*b* of the drum 24 will require a generally increased velocity of the strip 36 carrying the label 29. As mentioned above, it will be seen that as drum 24 moves in the direction 26 past the midpoint 30 thereof the surface 28*b* generally recedes or moves away from the labeling apparatus 38. Hence, the speed of the web 36 carrying the label must generally increase to follow this receding surface 28*b*.

As seen in FIG. 9, the label has been substantially completely distributed from the peeler plate 90 and all that remains is for the press roller 100 to complete application of the label 29. In this regard the spring loaded press roller will continue to engage the label 29 at least up to a point D which is substantially equidistant from midpoint 30 with point B. Additionally, the actuator 166 of sensor 49 will be seen to remain in its undisplaced position.

Figure 11:
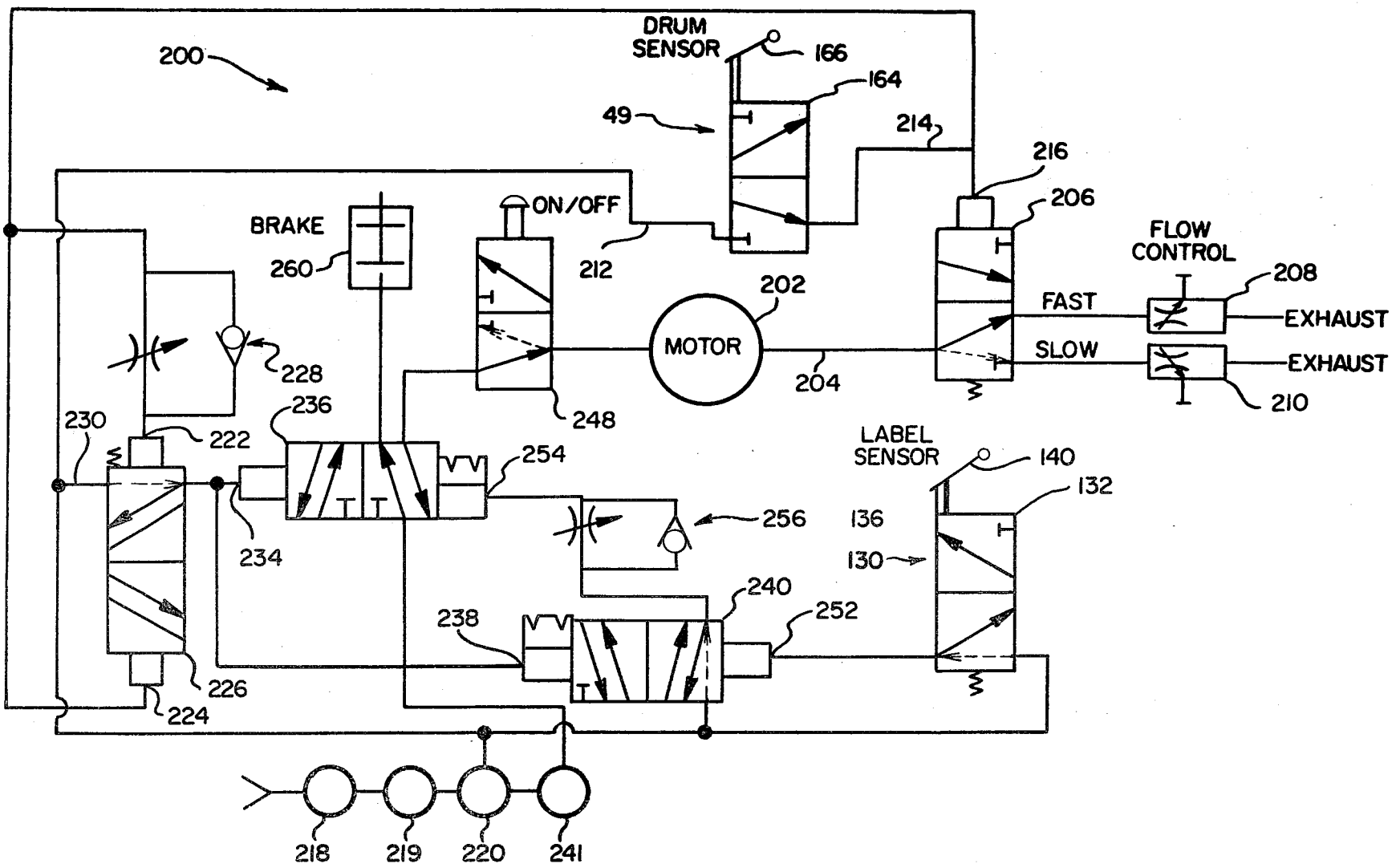
FIG. 11 is a functional schematic diagram of a pneumatic control system in accordance with a preferred form of the invention.

Referring now to FIG. 11, a novel pneumatic control system, designated generally by the reference numeral 200 is provided for controlling the drive 40 and takeup reel 46 described above with reference to FIG. 1 and FIG. 2. In FIG. 11, the components comprising the control system are illustrated schematically, utilizing A.N.S.I. symbols.

The drum sensor 49 including the actuator 166 and air switch 164 is here illustrated in schematic form. Similarly, the label sensor 130 including the actuator 140, plunger 136 and air switch 132 is also illustrated in schematic form. A suitable motor 202 is provided for driving both the drive mechanism 40, and particularly the drive wheel 42 thereof, and the takeup reel 46.

Preferably, this motor has its speed controlled by the adjustment of an outlet restriction for the air flow from an outlet 204 thereof. In this regard, a suitable pneumatic valve or air switching component 206 couples this outlet 204 to one of two adjustable flow restriction devices 208 or 210. The position of the valve 206 for selecting one of the two flow restrictors 208 or 210 is controlled in turn by the position of the air switch 164 associated with the drum sensor 49.

In this regard, when the actuator 166 is deflected by the approaching surface 28 of the drum 24 as described above, the air switch 164 feeds a supply of pressurized air from an inlet 212 to an outlet 214. This outlet 214 in turn feeds a control inlet 216 of the switching device 206. In response to the pressurized air at this control inlet 216 the switch 206 couples the motor outlet 204 to the second flow restrictor 210 as illustrated by the arrow in dashed line.

In accordance with a preferred form of the invention the flow restrictor 210 restricts the flow to a relatively greater degree than the flow restrictor 208 whereby the two restrictors are here labeled as "fast" and "slow", respectively. Responsive to this relatively slow flow, the speed of the motor 202 is reduced to a suitable level for applying the label 29 to the surface 28 up to and including the point C of the drum 24 as illustrated and described above with reference to FIGS. 8 through 10.

The supply of pressurized air for the inlet line 212 is provided from a suitable source of pressurized air (not shown) by way of suitable intervening filtering and regulation components illustrated schematically at 218, 219 and 220.

The outlet 214 from the air switch 164 also feeds a pair of control inlets 222 and 224 of a further valve or switching device 226. The first of these control inlets 222 is fed from the line 214 by way of a time delay component schematically illustrated at 228. The valve 226 is operative for switching the pressurized air supply received at an inlet 230 thereof from the components 218 through 220 mentioned above to an outlet 232 thereof. This outlet 232 feeds a control inlet 234 of a valve or switching component 236 and a similar control input 238 of a further similar valve or switching component 240.

The valve 236 is arranged in circuit for selectively applying the pressurized air provided by way of a further suitable lubricating component 241 at an inlet 242 thereof to an outlet 246 thereof which forms an air inlet to a further valve or switching component 248 which comprises an on/off switch for the motor 202. The valve 240 is arranged to reset the valve 236 in response to the label sensor 130, as will be described presently.

From the foregoing, it will be seen that initial actuation of the drum sensor actuator 166 causes selection of the "slow" speed control outlet restrictor 210 and simultaneously provides a supply of pressurized air for running the motor 202 by way of the above-described valves or switching components 232, 236 and 248. Thereafter, when the actuator 166 of the product sensor 49 returns to its original undeformed position as illustrated and described above with reference to FIGS. 8 through 10, the air switch portion 164 thereof will remove the pressurized air supply for the line 214. Thereupon, the flow restriction selection switch or valve 206 will return to its original position illustrated in solid line, thereby selecting the relatively larger and hence "fast" flow restrictor 208. This causes the speed of the motor 202 to increase in suitable fashion to apply the label 29 to the remaining receding portion of the curved surface 28 of the drum 24 as discussed above.

Since the valve 236 is a detent-type switch, however, the foregoing removal of air pressure from the line 214 will not affect the supply of pressurized air to the motor 202. Hence, the motor 202 will continue to run at the relatively faster speed due to the selection of the flow restrictor 208.

However, upon actuation of the label sensor 130, indicating that the next label 29 on the strip 36 has advanced to the applicator device 38 as described above, the motor 202 will be shut off after a suitable time delay. In this regard, the air switch 132 of the label sensor 130 is coupled for delivering the pressurized air supply provided by way of components 218 through 220 to a second control inlet 252 of the valve 240 described above. That is, when the actuator 140 is actuated as described above with reference to FIGS. 5 and 6, the air switch 132 assumes the position shown in dashed line in FIG. 11 to achieve this coupling. Responsively, the valve 240 now assumes the position shown in dashed line for further feeding this same pressurized air supply to a second control inlet 254 of the valve 236 by way of a suitable time delay device 256 which is similar to the time delay 228 described above.

In this regard, the time delay period provided by this time delay 256 is adjusted to delay the shut off of air supply to the motor 202 by the valve 236 a sufficient period to allow initial flagging out of a leading edge of the next succeeding label 29 of the strip 36 as described above.

Additionally, it will be noted that a suitable brake component 260 is also provided coupled with an outlet of the valve 236 for receiving the pressurized air from the inlet 242 thereof when this air to be switched away from the inlet 246 of the on/off switch 248 for the motor 202.

In operation, it will be noted that the label sensor air switch 132 resiliently returns to its position indicated in solid line when the actuator 140 and plunger 136 are no longer in the actuated condition. This occurs immediately after the passage of the leading edge of the next succeeding label thereby as described above with reference to FIGS. 5 and 6. However, the valve 240 is of the detent type, whereby it will not be reset to its position indicated in solid line until the next succeeding cycle of operation initiated by actuation of the product sensor actuator 166 by the approaching surface 28 of the next succeeding drum 24.

The valve 226 is also of the resiliently returning type, whereby removal of the air supply to the control inlet 224 thereof by the drum sensor air switch 164 as described above will cause it to return to the position illustrated in solid line. Additionally, the time delay 228 is provided to assure this return. As already mentioned, since the valve 236 which controls the flow of pressurized air to the motor 202 is of the detent type, it continues to deliver the pressurized air from the inlet 242 to its outlet 246 until de-activated by the action of the label sensor 130, valve 240 and time delay 256 as mentioned above. Hence, the control system of FIG. 11 is self-resetting for automatic control of the drive of the strip 36 and labels 29 thereof for applying the labels 39 to a plurality of drums 24 following in sequence down the assembly line 22.

Without in any way limiting the invention, but for purposes of disclosing a specific embodiment, the following components are preferably utilized in the control apparatus of FIG. 11:

| Specification Reference | Manufacturer's Part No. | Name | Manufacturer |
|---|---|---|---|
| Motor 202 | 7411 or 7412 | Reel winder | The Aro Corporation Bryan, Ohio ("ARO") |
| Drum sensor 49 | LR3-0201 | Limit valve with rotary actuator | Numatics, Inc. ("Numatics") |
| ON/OFF Valve 248 | 5830 | 3-Way valve with button actuator | ARO |
| Restrictors 208 & 210 | N20-B | Needle valve | Numatics |
| Valve 206 | 1P3-1 | Pilot actuated, spring return, relay valve | Numatics |
| Valve 226 | RA7-0101 | Relay valve | Numatics |
| Valve 236 | 1JDPA4 | 4-Way valve, detented | Numatics |
| Valve 240 | RA7-0103 | Relay valve | Numatics |
| Label Sensor 130 | LM3-0907 operated valve | 3-Way, lever | Numatics |
| Time Delay 228 & 256 | TMO-2111 | Timer | Numatics |

While the invention has been illustrated and described herein with reference to a preferred embodiment, the invention is not limited thereto. Those skilled in the art may devise various changes, alternatives and modifications upon reading the foregoing descriptions.

Such alternatives, changes and modifications form a part of the invention insofar as they fall within the spirit and scope of the appended claims.

The invention is claimed as follows:

1. An automatic labeling system for applying an elongate label to a preselected curved surface of each of a plurality of objects which move in succession along a given path of travel past a stationary work station, said system comprising: label applying means at said work station for applying said label to each said curved surface; controllable feed means for feeding said elongate labels to said applying means for application to said curved surface at a controllable speed; guide means for positioning said label applying means relative to each said curved surface said guide means comprising, pivotally mounted support means upon which said label applying means is mounted, tracking means carried by said support means and movable therewith for engaging and tracking the curved surface of the objects to which the labels are to be attached, and biasing means urging said pivotally mounted support means and said tracking means toward the path of travel of said objects to maintain said tracking means in engagement with the objects and properly position the label applying means with respect to the curved surfaces of the objects to which labels are to be applied; and control means for controlling the operation and speed of said feed means and correspondingly the application of said label to said curved surface in a predetermined fashion.

2. A system according to claim 1 wherein said control means comprises fluidic control means for operating said labeling system in a potentially volatile atmosphere.

3. A system according to claim 1 wherein said feed means comprises a supply reel for containing a supply of said elongate labels, transport means for transporting said elongate labels from said supply reel to said applying means and non-electric, fluidic drive means for driving said plurality of labels past said applying means for application to each said curved surface.

4. A system according to claim 3 wherein said labels comprise adhesive-backed labels carried sequentially on an elongate web comprised of a release liner material, and said system further including a takeup reel for taking up said elongate web from said transport means, and wherein said applying means comprises a peeler plate positioned in the path of said elongate web through said transport means to flag out each said label as it passes by said peeler plate.

5. A system according to claim 1 and further including position sensor means for detecting the initial presence and thereafter the position of said curved surface relative to said applying means and for producing feed control signals for controlling said feed means in accordance with the presence and relative position of said curved surface.

6. A system according to claim 5 and further including label sensing means for sensing the trailing end of each said elongate label on said elongate web and producing a stop control signal.

7. A system according to claim 6 wherein said feed control means comprises fluidic logic means responsive to said feed control signals for starting and thereafter controlling the speed of said feed means and responsive to said stop control signal for stopping said feed means after a predetermined time delay.

8. Apparatus according to claim 7 wherein said fluidic logic means comprises pneumatic logic means.

9. A system according to claim 5 wherein said feed control means includes means responsive to signals from said position sensor means for setting the speed of said feed means to a first predetermined speed and responsive to a second signal from said position sensor for setting the speed of said feed means to a second predetermined speed which is greater than said first predetermined speed.

10. A system according to claim 6 wherein said label sensing means comprises pneumatic valve means and mechanical valve actuator means biased into contact with the surface of said label carried on said web for detecting the end of said label on said web.

11. An automatic labeling system comprising: label applying means at a work station; feed means for feeding said elongate labels to said applying means for application of said labels to a plurality of objects passing said work station, said feed means comprising a fluid operated brake and a fluid operated motor for effecting the dispensing of labels which are alternately energizable; and control means disposable between a source of pressurized fluid and said feed means for controlling the operation of said feed means, said control means and said feed means comprising only fluidic means for operating said labeling system in a potentially volatile atmosphere, said control means including product sensing means operatively associated with a first valve means such that when a product is sensed, said valve is operated to discontinue the supply of pressurized fluid to said brake and apply said pressurized fluid to energize said fluid operated motor, and label sensing means also operatively associated with said first valve means for operation thereof to discontinue supply of pressurized fluid to said motor while energizing said fluid operated brake once a label has been dispensed.

12. An automatic labeling system according to claim 11 including means for controlling the speed of said fluid operated motor.

13. An automatic labeling system according to claim 11, wherein said product sensing means is capable of detecting a first condition of said product relative to said label applying means to operate said fluid motor at a first speed, and also to detect a second condition of the product relative to said label applying means to operate said fluid motor at a second speed; and said label sensing means detecting the presence of a label for application and upon the presence of a label maintaining the supply of pressurized fluid to said motor.

14. An automatic labeling system for applying an elongated label to a preselected curved surface of each of a plurality of objects which move in succession along a given path of travel past a stationary work station, said system comprising: label applying means at said work station for applying said label to each said curved surface; controllable feed means for feeding said elongate labels to said applying means for application to said curved surface at a controllable speed; guide means for positioning said label applying means relative to each said curved surface; and control means for controlling the operation and speed of said feed means, said control means comprising position sensor means detecting the relative position of the curved surface with respect to the label applying means, said position sensor means being responsive to said curved surface approaching said label applying means to operate said feed means at a first predetermined speed, and further being responsive to said curved surface receding from said label applying means to operate the feed means at a second predetermined speed.

15. Apparatus according to claim 14 wherein said position sensor comprises pneumatic valve means and mechanical valve actuator means extending into the path of travel to be contacted by said curved surface.

16. A system according to claim 15 wherein said mechanical value actuator means includes resilient means extending from a fixed position into said path of travel and responsive to said curved surface for movement generally in a first direction as said curved surface approaches said applicator means and for resiliently returning as said curved surface recedes from applicator means, said pneumatic valve means producing corresponding first and second signals.

17. An automatic labeling system for applying an elongate label to a preselected curved surface of each of a plurality of objects which move in succession along a given path of travel past a stationary work station, said system comprising: label applying means at said work station for applying said label to each said curved surface; controllable feed means for feeding said elongate labels to said applying means at a controllable speed, guide means for positioning said applying means relative to each said curved surface said guide means including pivotally mounted support means for said label applying means, and tracking means carried by said pivotally mounted support means for engaging and tracking the curved surface of the objects to which the labels are to be attached, and biasing means urging said pivotally mounted support means toward said path of travel to dispose said tracking means into said path for engaging said curved surface; and control means for controlling the operation and speed of said feed means and the application of said label in a predetermined fashion, such that said label is applied initially at a first speed and thereafter at a second faster speed.

18. A system according to claim 17 wherein said control means comprises fluidic control means for operating said labeling system in a potentially volatile atmosphere.

19. A system according to claim 17 wherein said feed means comprises a supply reel for containing a supply of said elongate labels, transport means for transporting said elongate labels from said supply reel to said applying means and non-electric, fluidic drive means for driving said plurality of labels past said applying means for application to each said curved surface.

20. A system according to claim 17 wherein said labels comprises adhesive-backed labels carried sequentially on an elongate web comprises of a release liner material, and said system further including a takeup reel for taking up said elongate web from said transport means, and wherein said applying means comprises a peeler plate positioned in the path of said elongate web through said transport means to flag out each said label as it passes by said peeler plate.

21. A system according to claim 17 wherein said tracking means comprises roller means and said pivotally mounted support means comprises a housing containing elements of said control means.

22. A system according to claim 17 further including position sensor means for detecting the initial presence and thereafter the position of said curved surface relative to said label applying means and for producing feed control signals for controlling said feed means in accordance with the presence and relative position of said curved surface.

23. A system according to claim 22 and further including label sensing means for sensing the trailing end of each said elongate label on said elongate web and producing a stop control signal.

24. A system according to claim 23 wherein said feed control means comprises fluidic logic means responsive to said feed control signals for starting and thereafter controlling the speed of said feed means and responsive to said stop control signal for stopping said feed means after a predetermined time delay.

25. Apparatus according to claim 22 wherein said position sensor comprises pneumatic valve means and mechanical valve actuator means extending into the path of travel to be contacted by said curved surface.

26. A system according to claim 22 wherein said mechanical valve actuator means includes resilient means extending from a fixed position into said path of travel and responsive to said curved surface for movement generally in a first direction as said curved surface approaches said applicator means and for resiliently returning as said curved surface recedes from applicator means, said pneumatic valve means producing corresponding first and second signals for controlling the speed of application of the labels.

27. A system according to claim 26 wherein said feed control means includes means responsive to said first signal for setting the speed of said feed means to a first predetermined speed and responsive to said second signal for setting the speed of said feed means to a second predetermined speed which is greater than said first predetermined speed.

* * * * *